US008371192B2

(12) United States Patent
Hsieh

(10) Patent No.: US 8,371,192 B2
(45) Date of Patent: Feb. 12, 2013

(54) IMPACT DRIVER

(75) Inventor: Chih-Ching Hsieh, Taichung County (TW)

(73) Assignee: Chihching Hsieh, Taichung County (TW)

( * ) Notice: Subject to any disclaimer, the term of this patent is extended or adjusted under 35 U.S.C. 154(b) by 346 days.

(21) Appl. No.: 12/756,182

(22) Filed: Apr. 8, 2010

(65) Prior Publication Data

US 2010/0192737 A1 Aug. 5, 2010

Related U.S. Application Data

(63) Continuation-in-part of application No. 12/101,102, filed on Apr. 10, 2008, now abandoned.

(51) Int. Cl.
*B25B 21/00* (2006.01)

(52) U.S. Cl. ..... 81/466; 81/463; 81/465

(58) Field of Classification Search ..... 81/463, 81/465, 466, DIG. 2; 74/127; 173/205, 121, 173/93, 93.5, 93.6
See application file for complete search history.

(56) References Cited

U.S. PATENT DOCUMENTS

| | | | | | |
|---|---|---|---|---|---|
| 91,634 | A * | 6/1869 | Hofer | 74/127 |
| 711,233 | A * | 10/1902 | Scott | 81/62 |
| 1,058,654 | A * | 4/1913 | Barber | 81/57.4 |
| 1,401,817 | A * | 12/1921 | Roberts | 81/63.1 |
| 1,513,212 | A * | 10/1924 | Beale et al. | 81/63 |
| 2,947,334 | A * | 8/1960 | Issartel | 74/127 |
| 3,511,286 | A * | 5/1970 | Brauchla | 74/127 |
| 4,306,599 | A * | 12/1981 | Kurahashi | 74/127 |
| 4,793,226 | A * | 12/1988 | Kress | 81/463 |
| 5,012,709 | A * | 5/1991 | Su | 81/466 |
| 6,370,993 | B1 * | 4/2002 | Pitstick | 81/463 |
| 6,647,837 | B2 * | 11/2003 | Liou | 81/466 |
| 7,946,198 | B2 * | 5/2011 | Gui et al. | 81/58.1 |

* cited by examiner

*Primary Examiner* — Robert Scruggs
(74) *Attorney, Agent, or Firm* — CKC & Partners Co., Ltd.

(57) ABSTRACT

An impact driver includes an outer sleeve, an inner core, at least one first pin, a moving mechanism, and a shank. The inner core is telescopically and rotatably received in the outer sleeve. The inner core has at least one first helix groove therein. The first pin slidably protrudes from the inner surface of the outer sleeve. The moving mechanism can move the first pin to fit the first helix groove. The shank is connected to the inner core.

8 Claims, 3 Drawing Sheets

IMPACT DRIVER

RELATED APPLICATIONS

The present application is a continuation-in-part application of my application Ser. No. 12/101,102, filed Apr. 10, 2008, entitled "Impact Screwdriver", currently pending. This application is incorporated herein by reference.

BACKGROUND

1. Technical Field

The present disclosure relates to tools. More particularly, the present disclosure relates to impact drivers.

2. Description of Related Art

An impact driver is a tool that applies a rotational and downward force to a bolt. Generally, the impact driver is used to unscrew bolts that may have become rusted into place. In use, the user may attach the tip of the impact driver to a troublesome bolt and then use a hammer to hit the impact driver. The impact driver can translate the motion of the hammer into a strong and sudden rotational motion to unscrew the troublesome bolt.

SUMMARY

According to one embodiment of the present disclosure, an impact driver includes an outer sleeve, an inner core, a switching mechanism, and a shank. The inner core is telescopically and rotatably received in the outer sleeve. The inner core has a left-handed helix groove and a right-handed helix groove therein. The switching mechanism can selectively connect the outer sleeve to one of the left-handed helix groove and the right-handed helix groove. The shank is connected to the inner core.

According to another embodiment of the present disclosure, an impact driver includes an outer sleeve, an inner core, at least one first pin, a moving mechanism, and a shank. The inner core is telescopically and rotatably received in the outer sleeve. The inner core has at least one first helix groove therein. The first pin slidably protrudes from the inner surface of the outer sleeve. The moving mechanism can move the first pin to fit the first helix groove. The shank is connected to the inner core.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
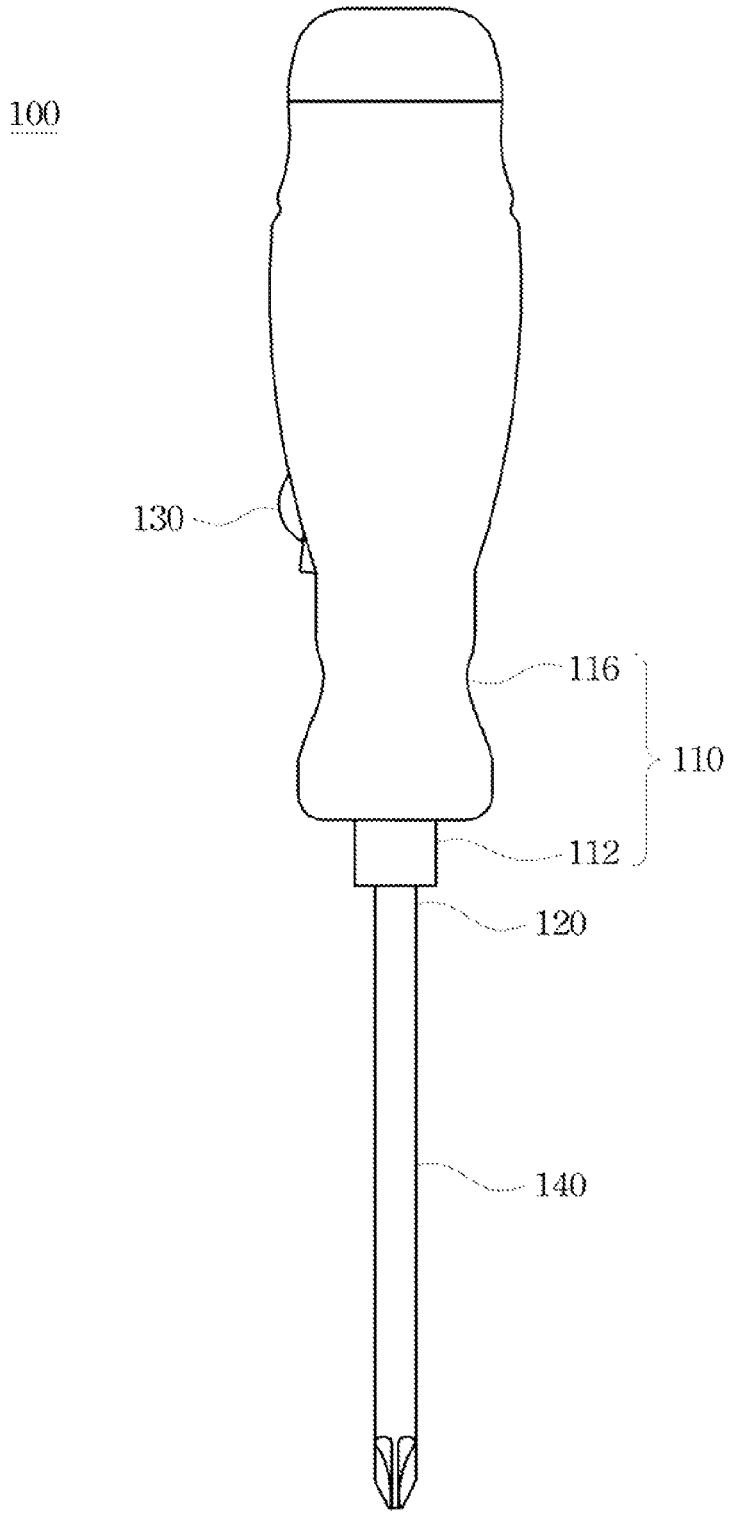
FIG. 1 is a front view of an impact driver according to one embodiment of the present disclosure.
Figure 2:
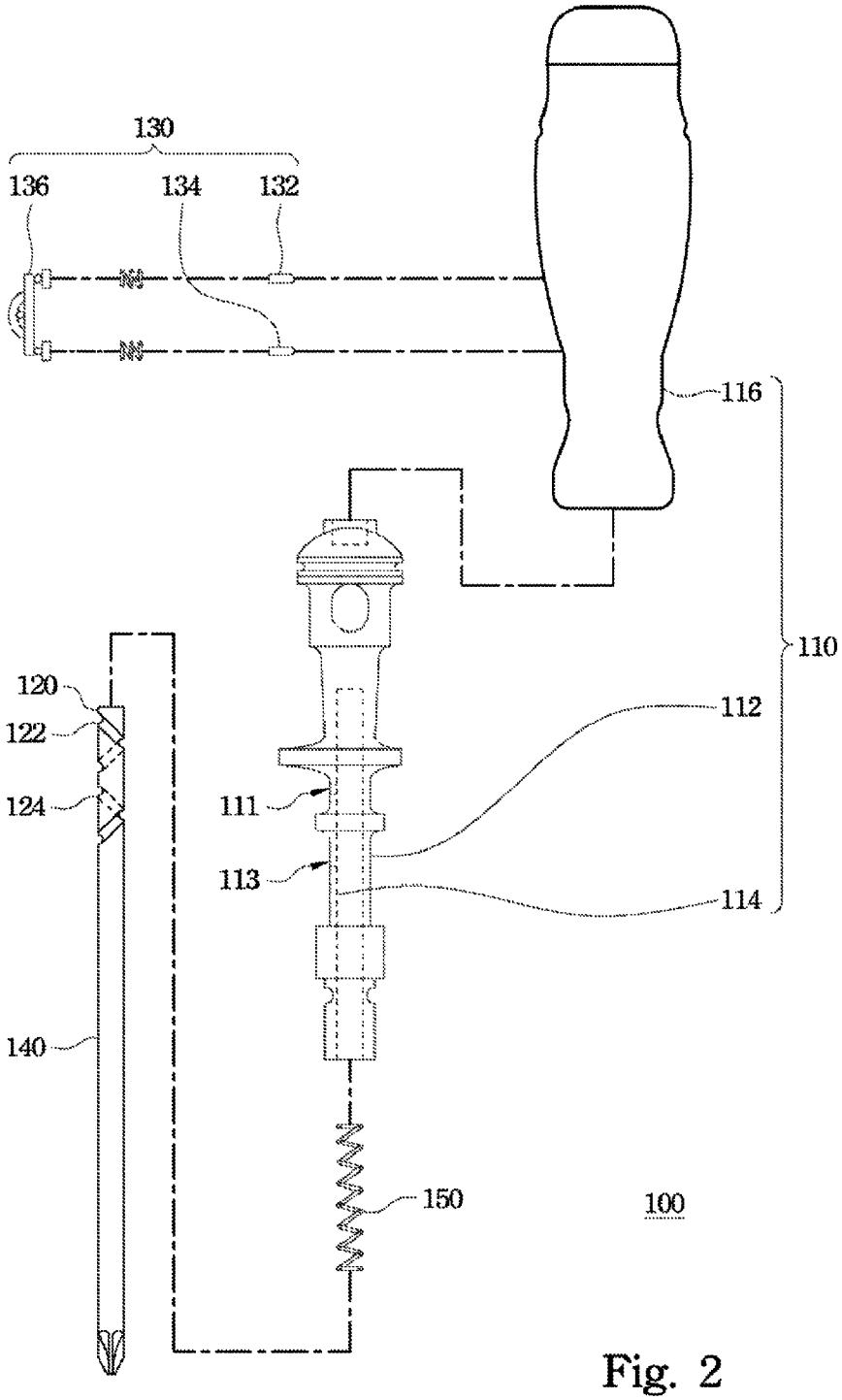
FIG. 2 is an exploded view of the impact driver of FIG. 1.

FIG. 1 is a front view of an impact driver 100 according to one embodiment of the present disclosure. FIG. 2 is an exploded view of the impact driver 100 of FIG. 1. As shown in FIGS. 1-2, the impact driver 100 includes an outer sleeve

110, an inner core 120, a switching mechanism 130, and a shank 140. The inner core 120 is telescopically and rotatably received in the outer sleeve 110. The inner core 120 has a left-handed helix groove 122 and a right-handed helix groove 124 therein. The switching mechanism 130 can selectively connect the outer sleeve 110 to one of the left-handed helix groove 122 and the right-handed helix groove 124. The shank 140 is connected to the inner core 120.

The outer sleeve 110 includes a sleeve body 112 and a handle cover 116. The inner core 120 is received in the sleeve body 112. The handle cover 116 surrounds the sleeve body 112. The sleeve body 112 may be made of metal, and the handle cover 116 may be made of metal or plastic. In one or more embodiment, the outer sleeve 110 is heavier than the inner core 120 to translate the heavy rotational inertia of the outer sleeve 110 to the inner core 120 to generate large amounts of torque.

The inner core 120 has the left-handed helix groove 122 and the right-handed helix groove 124 therein. The term "left-handed helix groove" means with the line of sight along the helix's axis, if a counterclockwise screwing motion moves the helix away from the observer, then it is a left-handed helix groove. The term "right-handed helix groove" means with the line of sight along the helix's axis, if a clockwise screwing motion moves the helix away from the observer, then it is a right-handed helix groove.

Figure 3:
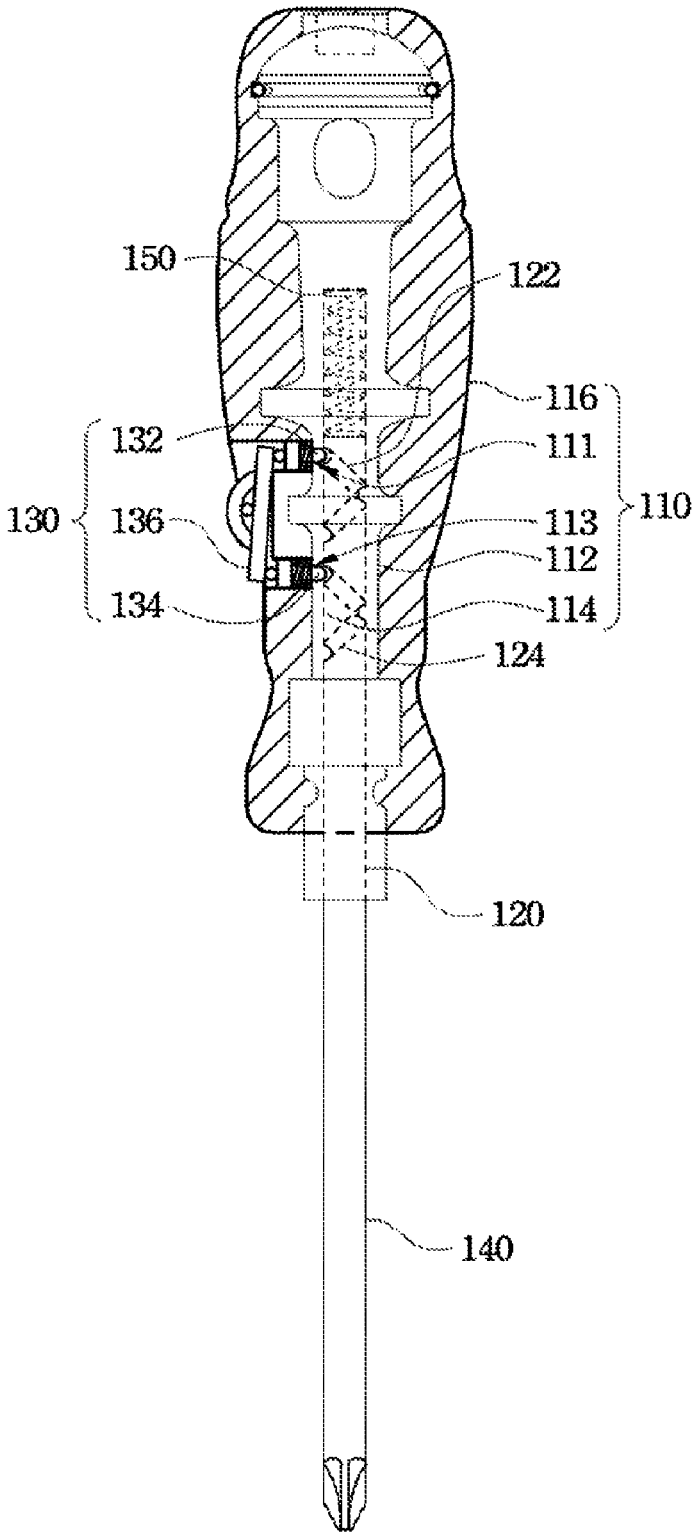
FIG. 3 is a cross sectional view of the impact driver of FIG. 1.

FIG. 3 is a cross sectional view of the impact driver 100 of FIG. 1. As shown in FIGS. 2-3, the outer sleeve 110 has at least one first pin hole 111 and at least one second pin hole 113. The first pin hole 111 is opposite the left-handed helix groove 122, and the second pin hole 113 is opposite the right-handed helix groove 124.

The switching mechanism 130 includes at least one first pin 132, at least one second pin 134, and a moving mechanism 136. The first pin 132 and the second pin 134 are telescopically received in the first pin hole 111 and the second pin hole 113 respectively. That is, both of the first pin 132 and the second pin 134 are capable of slidably protruding from the inner surface 114 of the outer sleeve 110. The moving mechanism 136 can move the first pin 132 to fit the left-handed helix groove 122 or move the second pin 134 to fit the right-handed helix groove 124.

Specifically, the moving mechanism 136 is a lever pivotally connected to the handle cover 116. The lever 136 may be against the first pin 132 for pushing the first pin 132 to engage the left-handed helix groove 122 or against the second pin 134 for pushing the second pin 134 to engage the right-handed helix groove 124. In FIG. 3, one end of the lever 136 is connected to the first pin 132, and the other end of the lever 136 is connected to the second pin 134.

In one or more embodiment, the first pin 132 may be spring-loaded for reciprocating motion in the first pin hole 111. Similarly, the second pin 134 may be also spring-loaded for reciprocating motion in the second pin hole 113.

The tip of the shank 140 may be shaped to fit Philips screws. It is appreciated that the tip of the shank 140 may be also shaped to fit other type screws, for instance, slotted screws, Pozidriv screws, Robertson screws, Allen screws, Torx screws, tri-wing screws, torq-set screws, spanner head screws, triple square screws, polydrive screws, one-way screws, spline drive screws, double hex screws, or Bristol screws.

The impact driver 100 of FIGS. 1-3 may further include an elastic member 150 for returning the outer sleeve 110 and the inner core 120 to their original locations after each turn. The elastic member 150 is received in the outer sleeve 110. One end of the elastic member 150 is against the outer sleeve 110, and the other end of the elastic member 150 is against the inner core 120. In one or more embodiments, the elastic member 150 is a compression spring.

In use, the user may push the switching mechanism 130 to connect the outer sleeve 110 to one of the left-handed helix groove 122 and the right-handed helix groove 124. If the outer sleeve 110 is connected to the left-handed helix groove 122 by the switching mechanism 130, the inner core 120 will be rotated clockwise (looking from the top) when the inner core 120 is telescoped into the outer sleeve 110. On the other hand, if the outer sleeve 110 is connected to the right-handed helix groove 124 by the switching mechanism 130, the inner core 120 will be rotated counterclockwise (looking from the top) when the inner core 120 is telescoped into the outer sleeve 110.

Then, the user may attach the tip of the shank 140 to a threaded fastener and strike the outer sleeve 110 with a hammer. At this time, the impact force working on the outer sleeve 110 is translated into a strong and sudden turning force on the inner core 120 to unscrew the threaded fastener.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An impact driver comprising:

an outer sleeve;

an inner core telescopically and rotatably received in the outer sleeve, the inner core having at least one first helix groove and at least one second helix groove therein;

at least one first pin slidably protruding from the inner surface of the outer sleeve;

a moving mechanism for moving the first pin to fit the first helix groove;

a shank connected to the inner core; and at least one second pin, wherein the outer sleeve has at least one first pin hole opposite the first helix groove and at least one second pin hole opposite the second helix groove, and the first pin and the second pin are telescopically received in the first pin hole and the second pin hole respectively.

2. The impact driver of claim 1, wherein the outer sleeve comprises:

a sleeve body, wherein the inner core is received in the sleeve body; and a handle cover surrounding the sleeve body, wherein the moving mechanism is a lever pivotally connected to the handle cover, and one end of the lever is against the first pin.

3. The impact driver of claim 1, wherein the outer sleeve comprises:

a sleeve body, wherein the inner core is received in the sleeve body; and a handle cover surrounding the sleeve body, wherein the moving mechanism is a lever pivotally connected to the handle cover, one end of the lever is connected to the first pin, and the other end of the lever is connected to the second pin.

4. The impact driver of claim 1, wherein the second pin is spring-loaded.

5. The impact driver of claim 1, wherein the first helix groove is left-handed, and the second helix groove is right-handed.

6. The impact driver of claim 1, wherein the first pin is spring-loaded.

7. The impact driver of claim 1, further comprising:

an elastic member, wherein one end of the elastic member is against the outer sleeve, and the other end of the elastic member is against the inner core.

8. The impact driver of claim 7, wherein the elastic member is received in the outer sleeve.

* * * * *